US008881584B2

(12) United States Patent
Spanos et al.

(10) Patent No.: US 8,881,584 B2
(45) Date of Patent: Nov. 11, 2014

(54) VARIABLE GUIDE VANE DIGITAL BACKLASH MEASUREMENT

(71) Applicant: General Electric Company, Schenectady, NY (US)

(72) Inventors: Charles V. Spanos, Greenville, SC (US); John William Herbold, Fountain Inn, SC (US); Andrew Thomas Hynous, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/845,163

(22) Filed: Mar. 18, 2013

(65) Prior Publication Data

US 2014/0260573 A1 Sep. 18, 2014

(51) Int. Cl.
*G01M 15/14* (2006.01)

(52) U.S. Cl.
CPC ..... *G01M 15/14* (2013.01)
USPC ..... 73/112.01

(58) Field of Classification Search
CPC ..... F02C 9/22; F01D 17/162; F01D 21/003; F01D 17/20; F05D 2260/80; G01B 5/24
USPC ..... 73/112.01
See application file for complete search history.

(56) References Cited

U.S. PATENT DOCUMENTS

| | | | | |
|---|---|---|---|---|
| 3,973,391 | A * | 8/1976 | Reed et al. | 60/794 |
| 4,597,187 | A * | 7/1986 | King | 33/552 |
| 4,718,172 | A * | 1/1988 | Rouse et al. | 33/530 |
| 6,341,238 | B1 * | 1/2002 | Modeen et al. | 700/66 |
| 6,404,184 | B1 | 6/2002 | Tabrizi | |
| 6,997,076 | B2 | 2/2006 | Menjak et al. | |
| 7,395,610 | B2 | 7/2008 | Suzuki et al. | |
| 7,578,072 | B2 | 8/2009 | Hayashida et al. | |
| 7,700,907 | B2 * | 4/2010 | Braun et al. | 250/231.13 |
| 8,033,785 | B2 | 10/2011 | Thermos et al. | |
| 8,528,207 | B2 * | 9/2013 | Lozier | 29/889.2 |
| 2009/0021247 | A1 * | 1/2009 | Braun et al. | 324/207.25 |
| 2012/0249129 | A1 * | 10/2012 | Niederbremer | 324/207.25 |
| 2013/0084179 | A1 * | 4/2013 | Mantese et al. | 416/1 |

* cited by examiner

*Primary Examiner* — Freddie Kirkland, III
(74) *Attorney, Agent, or Firm* — Dority & Manning, PA

(57) ABSTRACT

An apparatus and method for a more time efficient measurement of backlash in one or more variable guide vanes of a gas turbine system are provided. A mounting structure, with an indicator attached thereto, may be provided. Further, a guide structure may be provided to allow the mounting structure to be moved adjacent to two or more variable guide vanes without moving the guide structure.

20 Claims, 6 Drawing Sheets

VARIABLE GUIDE VANE DIGITAL BACKLASH MEASUREMENT

FIELD OF THE INVENTION

The present disclosure relates generally to gas turbines, or more particularly to an apparatus and method for measuring the amount of backlash in variable guide vanes of gas turbines.

BACKGROUND OF THE INVENTION

Industrial and power generation gas turbines include a compressor configured to provide compressed air to the gas turbine, or more particularly to one or more combustors in the gas turbine. Positioned at an inlet of the compressor is a plurality of circumferentially arranged inlet guide vanes (IGVs). The IGVs define an IGV angle that allows them to restrict airflow to the compressor during certain turbine operating modes and/or guide air as it enters the inlet of the compressor.

The IGVs are coupled to an actuator which may adjust the IGV angle. The actuator may include a rack and pinion gear system, wherein a primary gear runs circumferentially around the outside of a compressor casing and engages corresponding pinion gear wheels positioned at an end of each IGV. Rotating the pinion gear wheels at the end of each IGV rotates the IGV about its axis and changes the IGV angle. Thus, when the primary gear rotates circumferentially around the outside of the compressor casing, the pinion gear wheels positioned at the end of each IGV are engaged and correspondingly rotate about their respective axes, and the IGV angle adjusts accordingly.

In some instances, however, a portion of one or more of the pinion gear wheels, a portion of the primary gear, or both become worn. In such a case, one or more pinion gear wheels and corresponding IGVs may individually rotate about their respective axes while the primary gear remains stationary. This wear may be caused, e.g., by vibrations in the compressor while dust, metal fillings, etc. are caught between one or more of the pinion gear wheels and the primary gear. The amount that each of the pinion gear wheels and corresponding IGVs can move about their axes relative to the primary gear is referred to as the amount of "backlash." When there is backlash in the IGVs, the IGVs can flutter during operation, and when the amount of backlash is higher than a predetermined limit, the fluttering can cause damage to the compressor and the gas turbine.

As such, during e.g., maintenance outages of the gas turbine, it is occasionally necessary to measure the amount of backlash in the IGVs to ensure it is within the predefined limit. This measurement is commonly completed using a measurement device that magnetically mounts to the inside of the compressor casing, next to the IGV to be measured. The measurement device typically includes two or more adjustable linkages to align an indicator perpendicularly to a specific spot on an edge of the IGV. Once mounted and aligned, the indicator is zeroed and a measurement is taken while the IGV is manually moved by a worker. The measurement is typically recorded manually, and the process is repeated for each IGV. Measuring the backlash in the IGVs by such a process and with such a device is time consuming and tedious. For example, it may take two workers up to 18 hours to measure the backlash in each of the IGVs.

Accordingly, an apparatus and method that may reduce the amount of time and effort required to measure the backlash in each of the IGVs may be beneficial.

BRIEF DESCRIPTION OF THE INVENTION

Aspects and advantages of the present disclosure will be set forth in part in the following description, or may be apparent from the description, or may be learned through practice of the disclosure.

In one exemplary embodiment of the present disclosure, an apparatus is provided for measuring the change in position of a variable guide vane in a turbine system. The apparatus includes an electronic indicator having a body and a shaft extending from the body, wherein the electronic indicator measures displacement of the shaft relative to the body and generates an electronic signal indicative of the displacement. The apparatus also includes a mounting structure configured to be mounted adjacent to the variable guide vane, wherein the electronic indicator is attached to the mounting structure. Additionally, the mounting structure is configured to be moved relative to the variable guide vane.

In another exemplary embodiment of the present disclosure, a system is provided for measuring the change in position of one or more variable guide vanes in a turbine system. The system includes a mounting structure and an indicator attached to the mounting structure. The indicator is configured to measure variable guide vane displacements. The system also includes a guide structure configured to be mounted adjacent to two or more variable guide vanes. The mounting structure is configured to be moved relative to the guide structure such that the mounting structure is moveable between the two or more variable guide vanes without moving the guide structure.

In an exemplary aspect of the present disclosure, a method is provided for measuring the change in position of two or more variable guide vanes in a turbine system. The method includes determining a change in position of a first variable guide vane using an electronic indicator, the electronic indicator being moveable along a guide structure mounted within the turbine system. The method also includes moving the electronic indicator along the guide structure.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
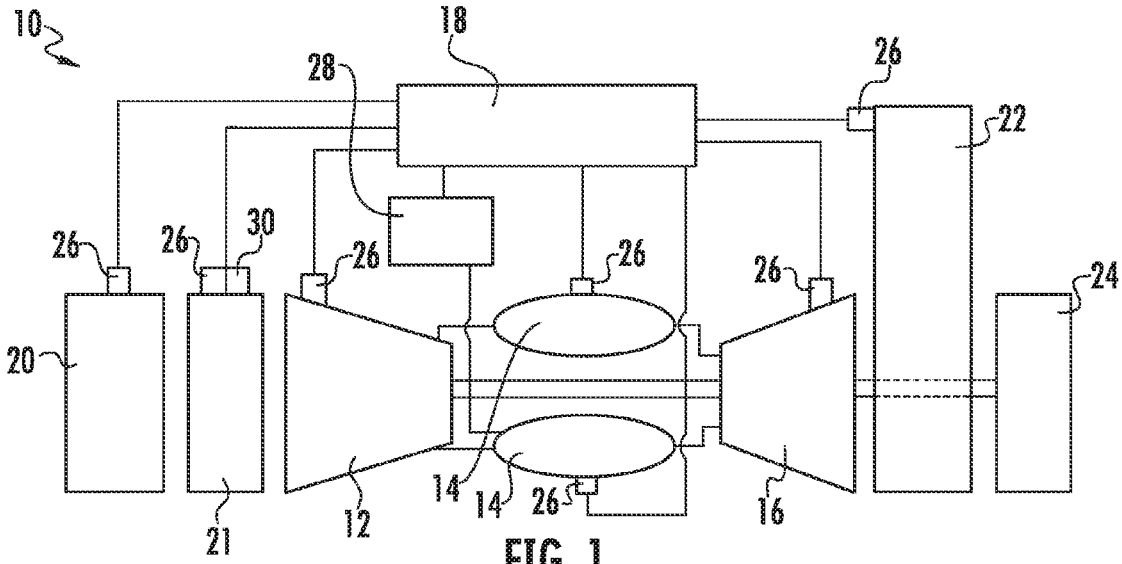
FIG. 1 provides a schematic drawing of an exemplary embodiment of a gas turbine of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

The present disclosure generally provides for more time efficient measurement of backlash in one or more variable guide vanes of a gas turbine system. A mounting structure may be provided, with an indicator attached thereto. Further, a guide structure may be provided to allow the mounting structure to be moved adjacent to two or more variable guide vanes without moving the guide structure.

Referring to the drawings, FIG. 1 illustrates a schematic view of an exemplary embodiment of a gas turbine 10 having a compressor 12, a plurality of combustors 14, a turbine 16 drivingly coupled to compressor 12, and a turbine control system 18 (hereinafter referred to as the "controller"). An inlet duct 20 to the compressor 12 having an inlet duct casing 34 (see FIGS. 7 and 8) feeds ambient air and possibly injected water into the compressor 12.

A first stage of compressor 12 may include a plurality of circumferentially arranged cantilevered variable guide vanes, more particularly known as inlet guide vanes 21 (IGVs). IGVs 21 define an IGV angle and are coupled to an actuator 30. Actuator 30 may adjust the IGV angle and may be controlled by controller 18 so as to regulate airflow flowing through compressor 12. For example, during base-load operation, IGVs 21 may be actuated to a fully open position, such as at an IGV angle of approximately 90 degrees, to allow maximum airflow through compressor 12. However, during part-load operation, IGVs 21 may be set to a more closed position, such as at an IGV angle of less than about 62 degrees, to reduce airflow through compressor 12.

In compressor 12, downstream of IGVs 21, may be one or more additional sets of variable guide vanes, known as variable stator vanes (not shown), circumferentially arranged in a similar manner as IGVs 21 and serving a similar function as IGVs 21. More particularly, the one or more sets of variable stator vanes may further regulate and or direct the airflow through compressor 12. An exhaust duct 22 of gas turbine 10 directs combustion gases from the outlet of turbine 16 through, for example, emission control and sound absorbing devices. Additionally, turbine 16 may drive a generator 24 that produces electrical power.

Gas turbine 10 may also include a plurality of fuel circuits configured to deliver fuel to the various fuel nozzles within the combustors 14. A fuel controller 28 may regulate the fuel flowing from a fuel supply to the combustors 14. It should be appreciated that the fuel controller 28 may comprise a separate unit or may be a component of the turbine controller 18.

The operation of gas turbine 10 may be monitored by several sensors 26 detecting various conditions of gas turbine 10, generator 24, and the ambient environment. For example, turbine 10 may include temperature sensors 26, humidity sensors 26 (e.g., wet and dry bulb thermometers), one or more IGV sensors 26, etc.

Controller 18 may generally be any turbine control system known in the art that permits a gas turbine 10 to be controlled and/or operated as described herein. For example, the controller 18 may comprise a General Electric SPEEDTRONIC Gas Turbine Control System, such as is described in Rowen, W. I., "SPEEDTRONIC Mark V Gas Turbine Control System," GE-3658D, published by GE Industrial & Power Systems of Schenectady, N.Y. Generally, controller 18 may comprise any computer system having one or more processor(s) and associated memory device(s) configured to perform a variety of computer-implemented functions to control gas turbine 10. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD), and/or other suitable memory elements.

As stated, when actuator 30 or one or more pinion gear wheels 32 (see FIGS. 7 and 8) become worn, a potentially harmful amount of backlash may be present in the IGVs 21. Accordingly, referring now to FIG. 2, an exemplary embodiment of an apparatus 100 of the present disclosure is provided for measuring the change in position, or backlash, of an IGV 21 in a gas turbine 10. While a perspective view of apparatus 100 is provided in FIG. 2, top views of apparatus 100 are provided in FIGS. 3 and 4, and a side view of apparatus 100 is provided in FIG. 5. As will be discussed further with reference to FIGS. 6 through 8, apparatus 100 may be attached to a guide structure to form a system 200 for measuring the change in position of one or more inlet guide vanes 21.

It should be appreciated, however, that although aspects of the present disclosure are discussed with reference to measuring the backlash of one or more IGVs 21, one having ordinary skill in the art will recognize that in other exemplary embodiments, apparatus 100 and/or system 200 can be configured to measure the displacement of other variable guide vanes in turbine system 10. More particularly, in other exemplary embodiments, apparatus 100 and/or system 200 can be configured to measure the displacement of one or more sets of variable stator vanes in compressor 12.

Figure 2:
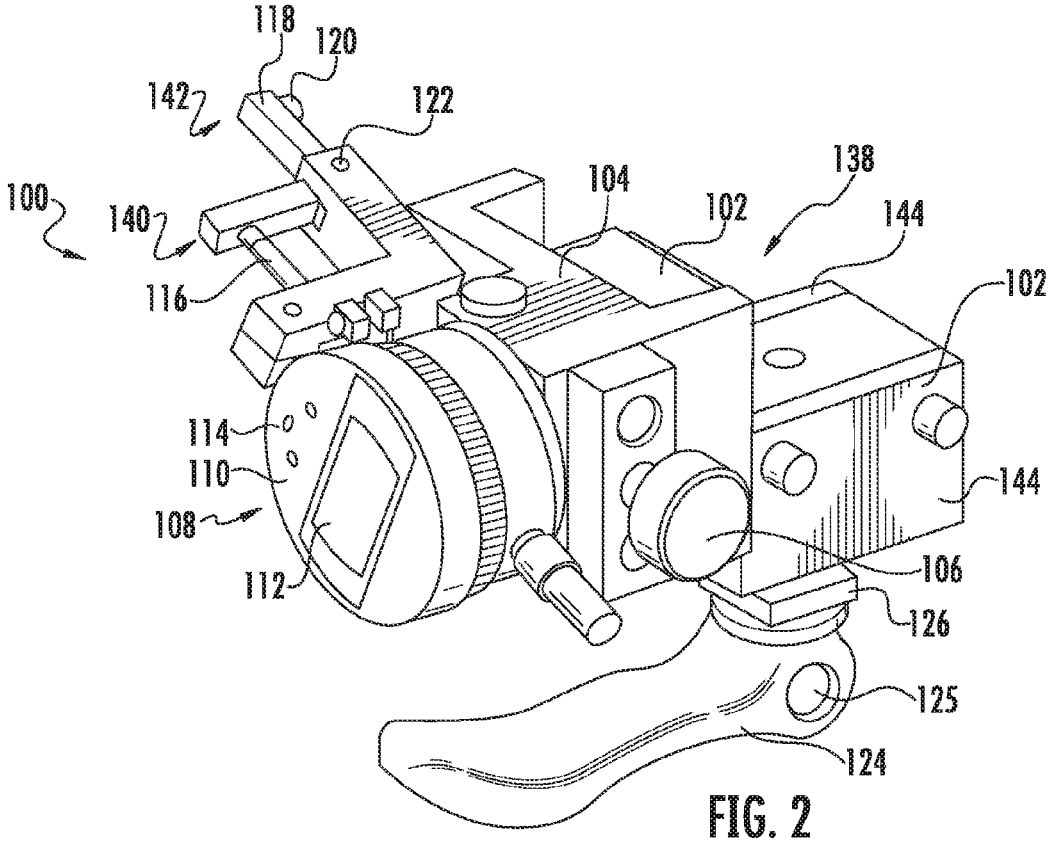
FIG. 2 provides a perspective view of one embodiment of an apparatus of the present disclosure for measuring the change in position of an inlet guide vane.

For the exemplary embodiment of FIG. 2, apparatus 100 includes a mounting structure 138 with an indicator 108 attached thereto. Mounting structure 138 includes a mounting block 102 and an indicator block 104, wherein indicator 108 is attached to indicator block 104. Further, indicator 108 is an electronic indicator 108, comprising a body 110 and a shaft 116 extending linearly therefrom.

Body 110 of indicator 108 includes a display, such as a digital display 112, and one or more buttons 114 for user input or control. Digital display 112 of indicator 108 allows a user to determine the measured change in position of an IGV 21 in real-time. Additionally, indicator 108 is configured to measure a displacement of shaft 116 relative to body 110 and to generate and record an electronic signal indicative of the measured displacement. Indicator 108 may also include a memory such that it may store one or more measurements. Any stored measurements in indicator 108 may be transferred wirelessly to a separate device, or the measurements may be transferred to a separate device by any other suitable means. For example, indicator 108 may include one or more ports, such as one or more Universal Serial Bus (USB) ports, or RS 232 ports, for exporting data through one or more cables. In one exemplary embodiment, digital indicator 108 may be an S Dial S233 digital indicator provided by SYLVAC SA of Switzerland.

Figure 7:
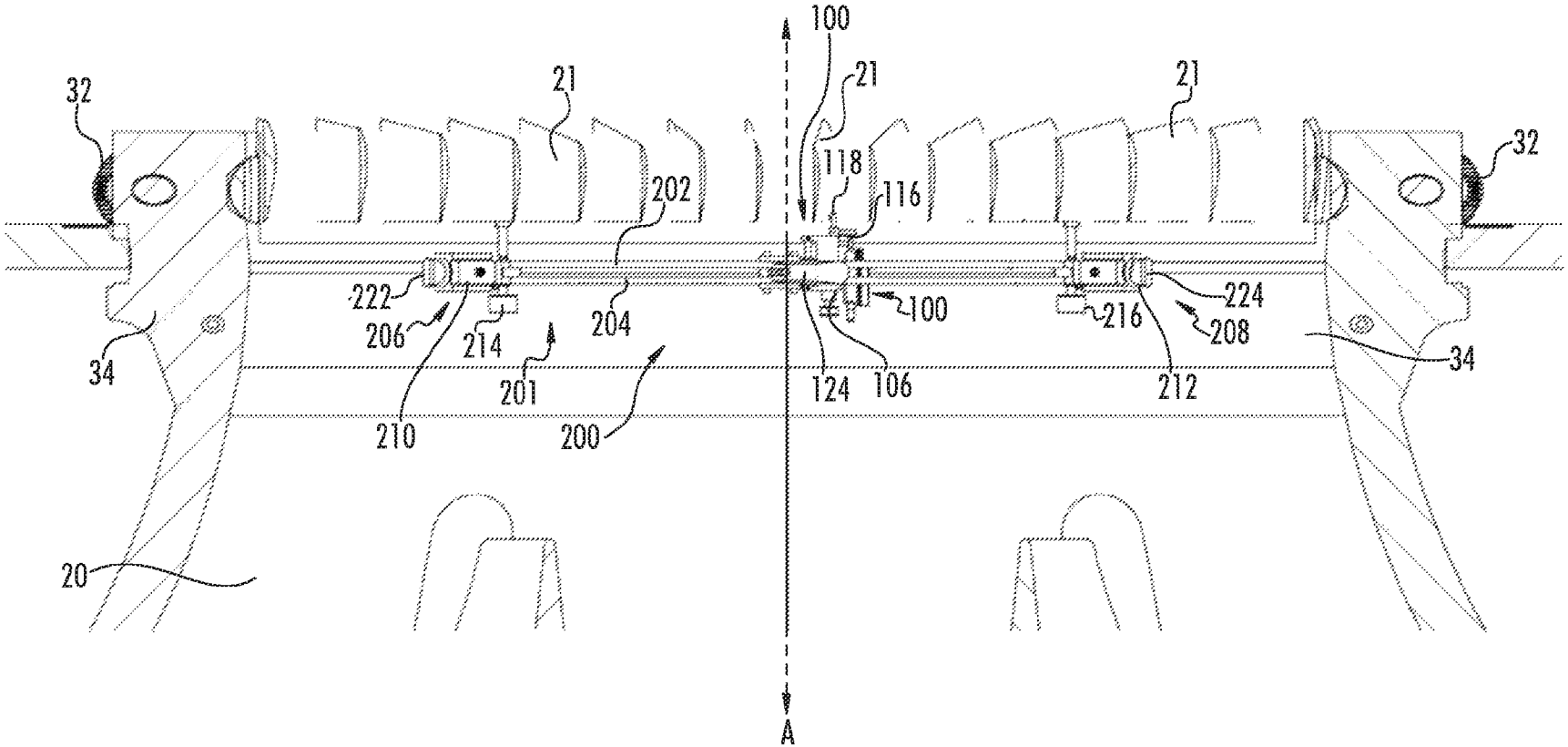
FIG. 7 provides a top view of the system of FIG. 6 mounted in a compressor of a gas turbine.
Figure 8:
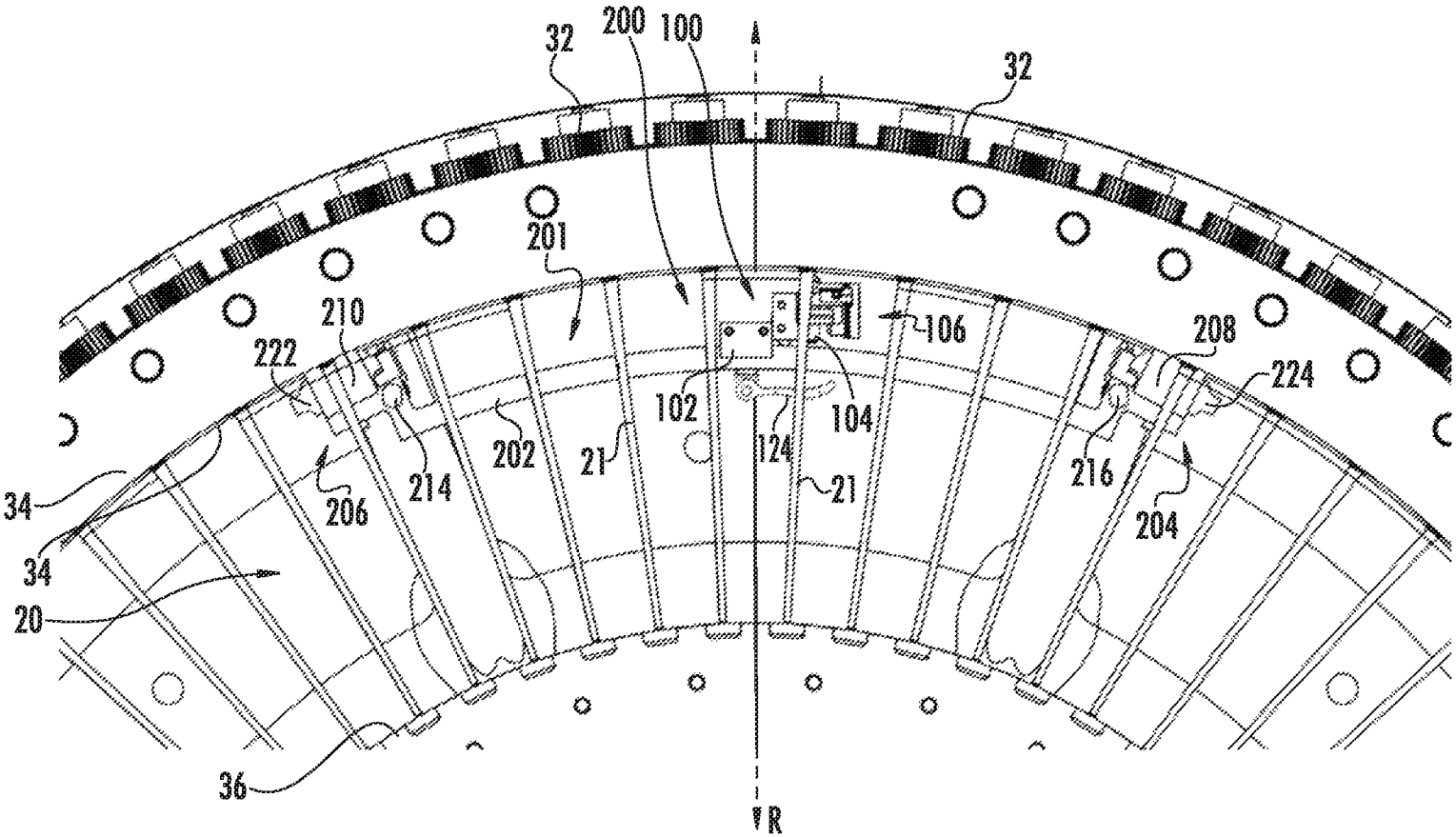
FIG. 8 provides a front view of the system of FIG. 6 mounted in a compressor of a gas turbine

Indicator 108 is configured for measuring the displacement of shaft 116 relative to body 110 in the direction shaft 116 extends from body 110. Accordingly, apparatus 100 includes a pivot bar 118 that is pivotally attached to indicator block 104 such that it may rotate about a pin 122. A first end 140 of pivot bar 118 is configured to contact shaft 116 of indicator 108, while a second end 142 of pivot bar 118, as will be explained further with reference to FIGS. 7 and 8, is configured to contact an IGV 21. When in contact with an IGV 21, any change in position of IGV 21 rotates pivot bar 118 about pin 122 such that a change in position of first end 140 of pivot bar 118, and thus of shaft 116, corresponds to a change in position of IGV 21. Pivot bar 118 thus allows indicator 108 to measure the change in position of an IGV 21 in a linear direction approximately perpendicular to the direction that shaft 116 extends from body 110 of indicator 108. A nub 120 may be provided at second end 142 of pivot bar 118 to improve the accuracy of the measurement of IGV's 21 change in position.

It should be appreciated, however, that in other exemplary embodiments of apparatus 100, other indicators may be used and other configurations of mounting structure 138 may be used. For example, in another exemplary embodiment of apparatus 100, indicator 108 may be a mechanical indicator, or alternatively, may be some other type of electronic indicator, such as a Linear Variable Differential Transformer (LVDT) indicator. Additionally, indicator 108 may measure the displacement of shaft 116 relative to body 110 in a direction other than the direction shaft 116 extends from body 110. For example, in another exemplary embodiment of apparatus 100, mounting structure 138 may not include pivot bar 118 and indicator 108 may measure the displacement of shaft 116 in a direction perpendicular to the direction shaft 116 extends from body 110.

Figure 3:
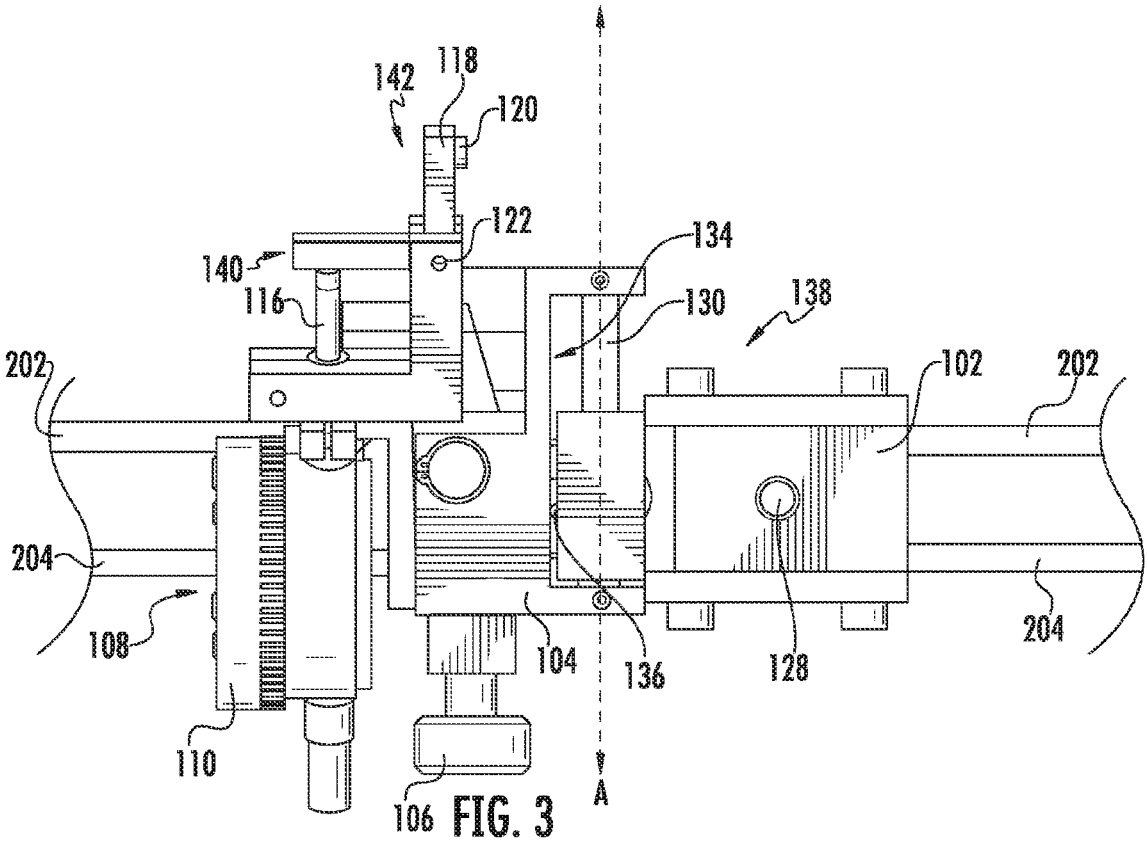
FIG. 3 provides a top view of the apparatus of FIG. 2 mounted to a guide structure.
Figure 4:
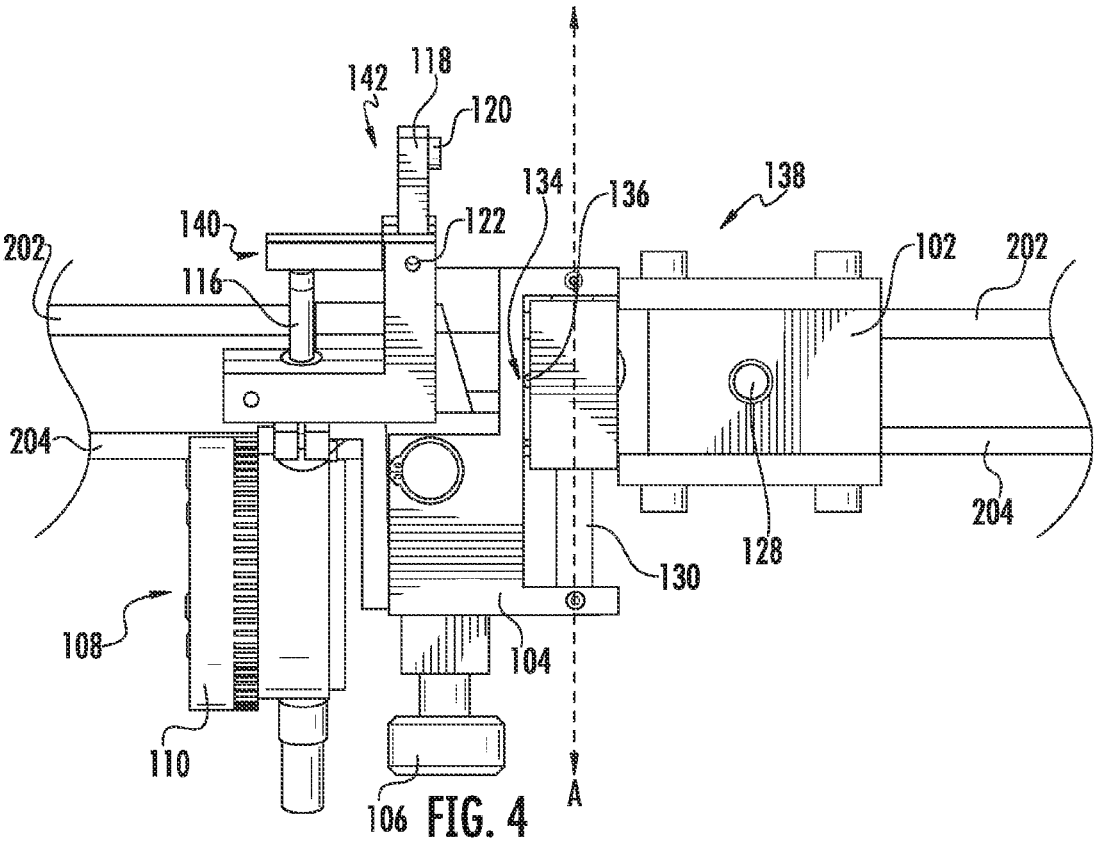
FIG. 4 provides an additional top view of the apparatus of FIG. 2 mounted to a guide structure.

Referring now to FIGS. 3 and 4, top views of apparatus 100 mounted to a forward rail 202 and a rear rail 204 of a guide structure 201 are provided. Rails 202, 204 and guide structure 201 will be discussed in detail with reference to FIGS. 6 through 8, below. As is evident from FIGS. 3 and 4, mounting structure 138 is configured to be moved relative to IGV 21, or more particularly, indicator block 104 may be moveable relative to mounting block 102. For the exemplary embodiment of FIGS. 3 and 4, indicator block 104 is slidably connected to mounting block 102, such that it may slide in an axial direction, A, of compressor 12 between a forward position, as shown in FIG. 3, and a rear position, as shown in FIG. 4. This functionality may be provided in this exemplary embodiment by two cylindrical bars 130, 132 extending between portions of indicator block 104 (see also FIG. 5) and two corresponding cylindrical openings in mounting block 102 through which bars 130 and 132 can slide. A knob 106 may be provided to assist a user in adjusting indicator block 104 between the forward and rear positions.

It should be appreciated, however, that in other exemplary embodiments of the present disclosure, mounting structure 138 may have any other configuration suitable for variable positioning relative to an inlet guide vane 21. By way of example, mounting structure 138 may include a mounting block 102 hinged to an indicator block 104. Alternatively, instead of indicator block 104 freely sliding between the forward and rear positions, mounting structure 138 may include a bolt in place of, or in addition to, bars 130, 132 that passes through a correspondingly threaded cylindrical hole in mounting block 102. Such a bolt may also be rotatably attached to indicator block 104, such that "tightening" or "loosening" the bolt moves indicator block in axial direction A.

Figure 5:
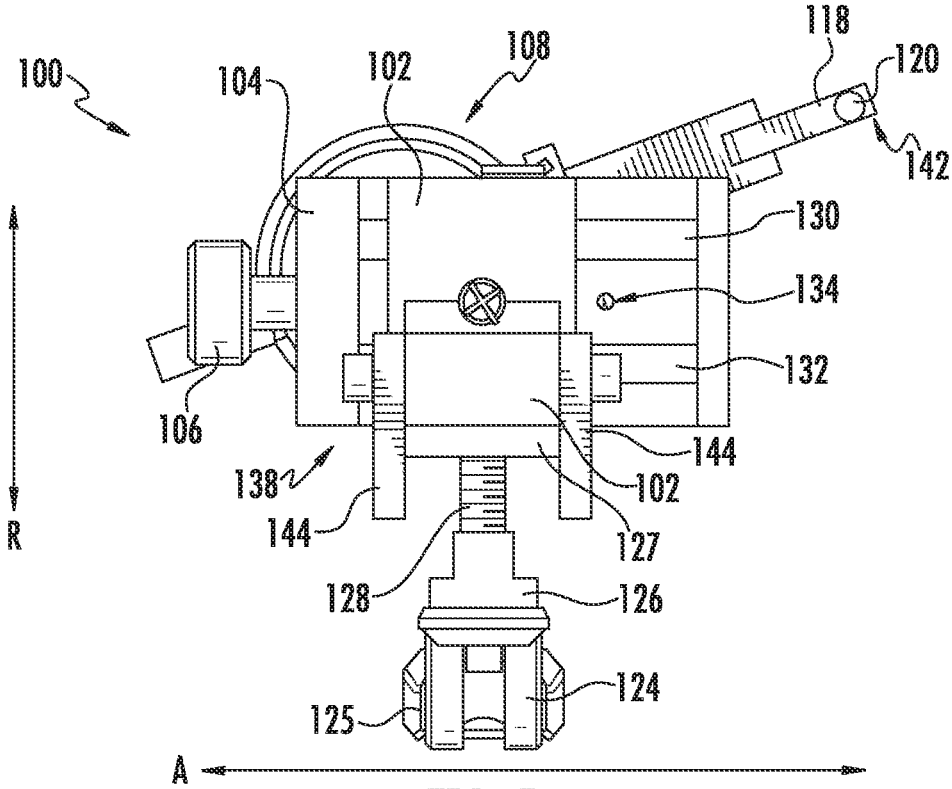
FIG. 5 provides a side view of the apparatus of FIG. 2.
Figure 6:
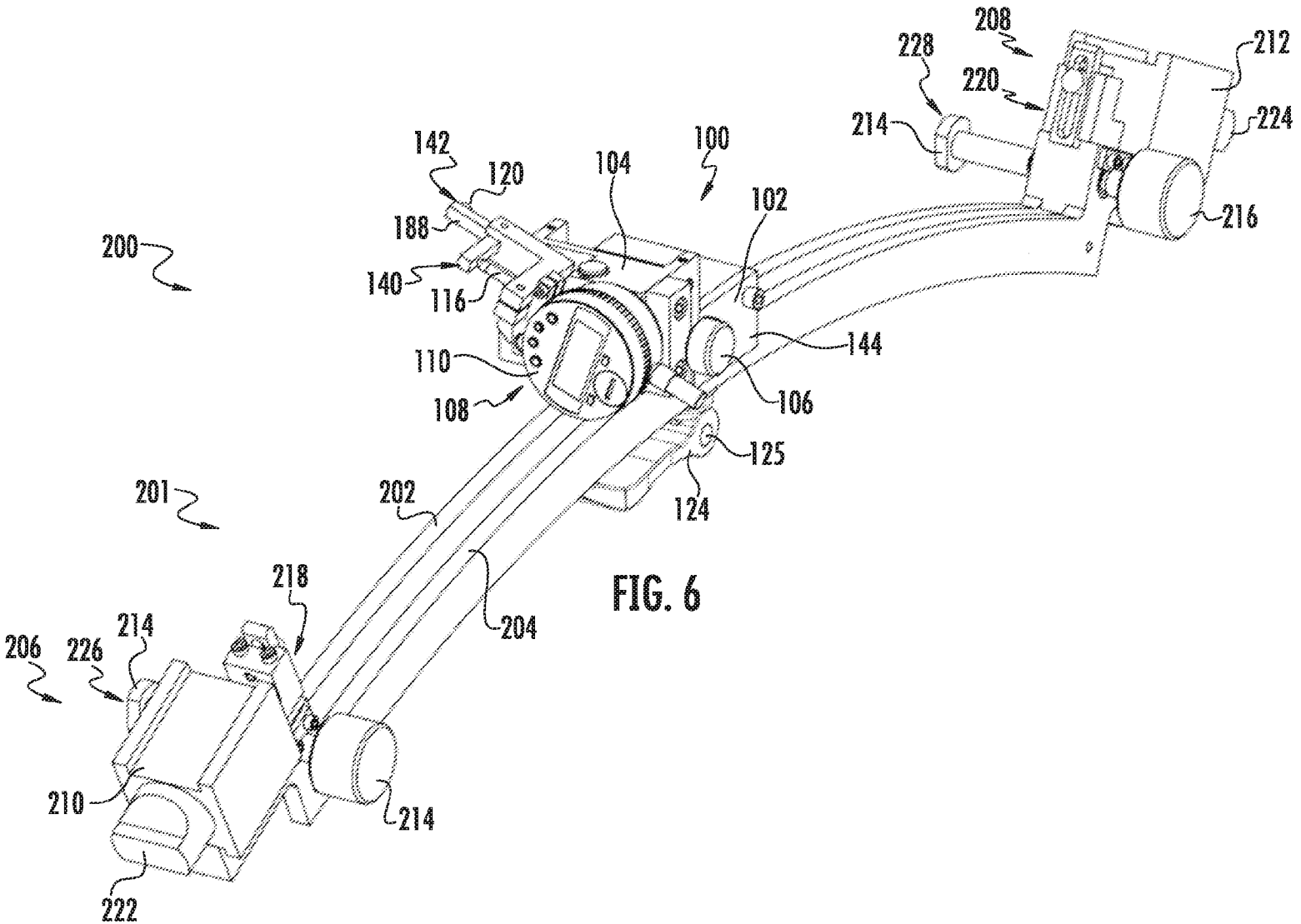
FIG. 6 provides a perspective view of one embodiment of a system of the present disclosure for measuring the change in position of one or more inlet guide vanes.

Referring now to FIG. 5, mounting structure 138 is configured for mounting on guide rails 202, 204 (see also FIG. 6). As such, mounting structure 138 includes a pair of mounting plates 126, 127 with a bolt 128 connecting the two. Bolt 128 may be a quick-release bolt, such that it includes a handle 124 for quickly tightening and loosening bolt 128. Handle 124 may rotate about a pin 125, between a tightened position, as shown in FIGS. 2 and 5, and a loosened position, wherein handle 124 is rotated about pin 125 away from mounting block 102 in a radial direction R (not shown). Side walls 144 may also be provided to add further security and accuracy when mounting structure 138 is attached or secured to guide rails 202, 204. In other exemplary embodiments of the present disclosure, however, any other suitable means may be used to attach mounting structure 138 to one or more guide rails. For example, in other exemplary embodiments, a wing nut may be used to tighten and loosen bolt 128.

In order to ensure indicator block 104 stays in the correct position relative to mounting block 102, indicator block 104 may include a first aperture 134 (see FIG. 5) and a second aperture (not shown). Additionally, mounting block 102 may include a spring loaded nub 136 that fits into first aperture 134 when indicator is in the rear position (see FIG. 4), and into the second aperture (not shown) when indicator is in the forward position (see FIGS. 3 and 5). Nub 136 may resist movement in axial direction A when positioned in first aperture 134 or second aperture (not shown).

Referring now to FIG. 6, a perspective view of a system 200 for measuring the change in position of one or more IGVs 21 is provided. System 200 includes a guide structure 201, mountable adjacent to two or more IGVs 21, and mounting structure 138 moveably attached thereto, such that mounting structure 138 is configured for movement adjacent to two or more IGVs 21 without moving the guide structure 201. This functionality will be discussed further with reference to FIGS. 7 and 8, below.

For the exemplary embodiment of FIG. 6, guide structure 201 includes a forward rail 202 and a rear rail 204, each extending between a first end 206 and a second end 208. As will be shown more clearly with reference to FIG. 8, guide rails 202 and 204 have an arcuate shape that is complementary to the shape of a portion of the inlet duct 20, where system 200 is mountable. First and second ends 206, 208 each include magnetic mounts 210 and 212 configured for contacting the casing 34 of inlet duct 20 and holding system 200 in place adjacent to two or more IGVs 21 while measurements of the change in position, or backlash, of two or more IGVs 21 are taken using mounting structure 138 and indicator 108.

In certain exemplary embodiments, it may be desirous for apparatus 100 to be accurately positioned to ensure consistent and accurate measurements may be taken. More particularly, for the exemplary embodiment of FIG. 6, second end 142 of pivot bar 118 may be aligned with each IGV in, e.g., axial direction A and radial direction R. To provide such functionality, guide structure 201 further includes axial alignment structures 214 and 216 and radial alignment structures 218 and 220. Axial alignment structures 214 and 216 each include forward ends 226 and 228, respectively. Forward ends 226 and 228 are configured to align with the edges of IGVs 21 (see FIG. 7) and ensure that guide structure 201 is mounted at a consistent distance from the IGVs 21.

In one exemplary embodiment, axial alignment structures 214, 216 may be adjustable in axial direction A, such that they may extend and retract from the first and second ends 206, 208 of guide structure 201. To provide this functionality, first and second ends 206, 208 may each include a threaded portion through which alignment structures 214, 216 extend. In such an embodiment, alignment structures 214, 216 may be extended or refracted by twisting the structures. Additionally, radial alignment structures 218, 220 may be of any suitable configuration for adjusting the position of guide structure 201 in the radial direction R of compressor 12.

It should be appreciated, however, that in other exemplary embodiments of guide structure 201, any other suitable means may be provided for aligning guide structure 201 in axial direction A and radial direction R, and for mounting system 200 to casing 34 of inlet duct 20. For example, in other exemplary embodiments of the present disclosure, an air suction system may be provided for mounting system 200 to casing 34 of inlet duct 20. Additionally, other exemplary embodiments of the present disclosure may utilize various other suitable configurations of guide rails 202 and 204 and mounting structure 138. By way of example, in other exemplary embodiments, guide structure 201 may include a different number of guide rails, and/or guide rails may have a different cross sectional shape.

FIGS. 7 and 8 provide a top view and front view, respectively, of system 200 of the present disclosure mounted to the casing 34 of inlet duct 20 of a gas turbine 10. Notably, the present disclosure contemplates usage of system 200 in, e.g., turbines wherein inlet duct 20 and IGVs 21 are integrally connected with compressor 12, as well as turbines wherein inlet duct 20 is a separate component of turbine 10. As used herein, inlet duct 20 may refer to any structural component positioned adjacent to an end of one or more IGVs 21 in a turbine system.

In an illustrative embodiment of the present disclosure, the backlash of two or more IGVs 21 may be measured by first mounting guide structure 201 to casing 34 of inlet duct 20 adjacent to two or more IGVs 21. Guide structure 201 may be aligned in axial direction A using axial alignment structures 214, 216 and in radial direction R using radial alignment structures 218, 220 (see FIG. 6). Mounting structure 138 may be moved along guide structure 201 to a position adjacent to a first IGV 21 to be measured. Indicator block 104 may be moved forward in axial direction A to the forward position (see FIG. 3) such that second end 142 of pivot bar 118 contacts the first IGV 21 to be measured. Using electronic indicator 108, configured for generating and recording an electronic signal indicative of the change in position of one or more IGVs 21, the backlash of the first IGV 21 may be measured, recorded, or both while IGV 21 is moved back and forth by, e.g., the user. Once measured, indicator block may be moved rearwardly in axial direction A to the rear position (see FIG. 4). Additionally, bolt 128 may be loosened, e.g., by rotating quick release bolt handle 124 about pin 125 in radial direction R away from mounting structure 138.

Once indicator block 104 is moved to the rear position and bolt 128 is loosened, mounting structure 138 may be moved along guide structure 201 such that it is positioned adjacent to a second IGV 21. Notably, for the exemplary embodiment of FIGS. 7 and 8, indicator block 104 may be moved to the rear position in order to allow apparatus 100, or more particularly, second end 142 of pivot bar 118, to more freely move between IGVs 21 along guide structure 201. After mounting structure is positioned adjacent to a second IGV 21, bolt 128 may be tightened by, e.g., rotating quick release bolt handle 124 about pin 125 in radial direction R towards mounting structure 138. Additionally, indicator block 104 may be moved to the forward position (see FIG. 3) such that second end 142 of pivot bar 118 contacts the second IGV 21 to be measured. Indicator 108 may then measure the amount of backlash in the second IGV 21 while the second IGV 21 is moved back and forth by, e.g., the user. The process may be repeated for as many times as required or for as many times as allowed by system 200, such that the backlash in each of, e.g., a third IGV, a fourth IGV, a fifth IGV, etc. are all measured.

It should be appreciated, however, that although the exemplary embodiment of FIGS. 6 through 8 depicts system 200 as being mountable to inlet duct casing 34, in other exemplary embodiments of the present disclosure, system 200 may be mounted to, e.g., a center cone in inlet duct 20 (not shown). In such an embodiment, system 200 may be setup in essentially the same manner, but with the shape of guide rails 202, 204 being reversed. Other aspects of system 200 may need to be adjusted in such an embodiment as well, e.g., the angle at which indicator 108 is mounted to indicator block 104.

Similarly, it should also be appreciated that in other exemplary embodiments, apparatus 100 and/or system 200 can be used to measure the displacement of other variable guide vanes, such as one or more sets of variable stator vanes in compressor 12. In such an exemplary embodiment, system 200 can be configured to be mounted to, e.g., a compressor casing adjacent to one or more variable stator vanes.

This written description uses examples to disclose the invention, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An apparatus for measuring the change in position of a variable guide vane in a turbine system, comprising:

an electronic indicator comprising a body and a shaft extending from the body, wherein the electronic indicator measures displacement of the shaft relative to the body and generates an electronic signal indicative of the displacement; and a mounting structure configured to be mounted within a casing of the turbine system adjacent to an end of the variable guide vane along an axial direction of the turbine system, wherein the electronic indicator is attached to the mounting structure and the mounting structure is configured to be moved relative to the variable guide vane.

2. An apparatus as in claim 1, wherein the mounting structure comprises:

a mounting block; and an indicator block, wherein the indicator block is moveable relative to the mounting block, and wherein the indicator is attached to the indicator block.

3. An apparatus as in claim 1, wherein the mounting structure is configured to be mounted within an inlet duct of the turbine system.

4. An apparatus as in claim 1, further comprising a pivot bar pivotally attached to the mounting structure, wherein a first end of the pivot bar is configured to contact the shaft of the indicator and a second end of the pivot bar is configured to contact the variable guide vane.

5. A system for measuring the change in position of one or more variable guide vanes in a turbine system, comprising:

a mounting structure;

an indicator attached to the mounting structure, wherein the indicator is configured to measure variable guide vane displacements; and a guide structure configured to be mounted to a surface within a casing of the turbine system adjacent to an end of two or more variable guide vanes along an axial direction of the turbine system, wherein the mounting structure is configured to be moved relative to the guide structure such that the mounting structure is moveable between the two or more variable guide vanes without moving the guide structure.

6. A system. as in claim 5, wherein the mounting structure comprises:

a mounting block; and an indicator block, wherein the indicator block is moveable relative to the mounting block, and wherein the indicator is attached to the indicator block.

7. A system as in claim 6, wherein the indicator block, is slidably connected to the mounting block such that the indicator block is capable of moving closer to or further away from the two or more variable guide vanes.

8. A system as in claim 5, further comprising a pivot bar pivotally attached to the mounting structure, wherein a first end of the pivot bar is configured to contact the indicator and a second end of the pivot bar is configured to contact the variable guide vane.

9. A system as in claim 5, wherein the indicator is an electronic indicator configured to generate an electronic signal indicative of the two variable guide vane displacement measurements.

10. A system as in claim 5, wherein the surface within the casing of the turbine system is an inner surface of an inlet duct of the turbine system.

11. A system as in claim 5, wherein the guide structure comprises a first end, a second end, and a first guide rail extending between the first and second ends, wherein the first guide rail has a shape that is complementary to a portion of an inlet duct of the turbine system, and wherein the variable guide vane comprises an inlet guide vane.

12. A system as in claim 11, wherein the first end and the second end each comprise a magnetic mount configured for mounting the guide structure to a casing of the inlet duct.

13. A system as in claim 11, wherein the first end and the second end each comprise an alignment structure configured for aligning the guide structure in an axial direction of the turbine system.

14. A system as in claim 11, wherein the mounting structure is configured to be attached to the first guide rail using a bolt-type fastener.

15. A system as in claim 11, wherein the guide structure further comprises a second guide rail extending parallel to the first guide rail between the first end and second end of the guide structure, and wherein the mounting structure comprises mounting plates positioned on opposing sides of the guide rails, the mounting plates being connected together with a bolt.

16. A method for measuring the change in position of two or more variable guide vanes in a turbine system, comprising:

determining a change in position of a first variable guide vane using an electronic indicator, the electronic, indicator being moveable along a guide structure mounted within a casing of the turbine system adjacent to an end of a variable guide vane along an axial direction of the turbine system; and moving the electronic indicator along the guide structure.

17. A method as in claim 16, wherein the electronic indicator is attached to a mounting structure comprising a mounting block and an indicator block, the electronic indicator being attached to the indicator block and the indicator block being moveable relative to the mounting block, the method further comprising:

moving the indicator block relative to the mounting block towards the first variable guide vane to allow the electronic indicator to be used to determine the change in position of the first variable guide vane; and moving the indicator block relative to the mounting block away from the first variable guide vane after the change in position of the first variable guide vane has been determined.

18. A method as in claim 16, wherein moving the electronic indicator along the guide structure comprises:

moving the electronic indicator along the guide structure from a location adjacent to the first variable guide vane to a location adjacent to a second variable guide vane.

19. A method as in claim 18, further comprising:

determining a change in position of the second variable guide vane using the electronic indicator.

20. A method as in claim 18, wherein the guide structure comprises a first end, a second end, and a guide rail extending between the first and second ends, the electronic indicator being configured to slide along the guide rail between the location adjacent to the first variable guide vane and the location adjacent to the second variable guide vane.

* * * * *